US011854488B1

(12) United States Patent
Zhou et al.

(10) Patent No.: US 11,854,488 B1
(45) Date of Patent: Dec. 26, 2023

(54) PIXEL DRIVING CIRCUIT HAVING A COUPLING CAPACITANCE AND DISPLAY PANEL THEREOF

(71) Applicant: HKC CORPORATION LIMITED, Shenzhen (CN)

(72) Inventors: Xiufeng Zhou, Shenzhen (CN); Xin Yuan, Shenzhen (CN); Haijiang Yuan, Shenzhen (CN)

(73) Assignee: HKC CORPORATION LIMITED, Shenzhen (CN)

( * ) Notice: Subject to any disclaimer, the term of this patent is extended or adjusted under 35 U.S.C. 154(b) by 0 days.

(21) Appl. No.: 18/068,786

(22) Filed: Dec. 20, 2022

(30) Foreign Application Priority Data

Jun. 30, 2022 (CN) ..... 202210756405.2

(51) Int. Cl.
*G09G 3/3258* (2016.01)
*G09G 3/3283* (2016.01)

(52) U.S. Cl.
CPC ..... *G09G 3/3258* (2013.01); *G09G 3/3283* (2013.01); *G09G 2310/0272* (2013.01); *G09G 2320/0233* (2013.01)

(58) Field of Classification Search
CPC ..... G09G 3/3258
USPC ..... 345/55
See application file for complete search history.

(56) References Cited

U.S. PATENT DOCUMENTS

2015/0243220 A1* 8/2015 Kim ..... H01L 27/1225 345/215
2016/0005384 A1* 1/2016 Yoon ..... G09G 3/3291 345/82
2016/0035277 A1* 2/2016 Han ..... G09G 3/3233 345/80
2017/0256205 A1 9/2017 Zhu et al.

FOREIGN PATENT DOCUMENTS

CN 103150992 A 6/2013
CN 105590585 A 5/2016
CN 106652912 A 5/2017
CN 106782330 A 5/2017
CN 108597450 A 9/2018
CN 109616063 A 4/2019
CN 112071259 A 12/2020
CN 114120910 A 3/2022

* cited by examiner

*Primary Examiner* — Long D Pham
(74) *Attorney, Agent, or Firm* — Maier & Maier, PLLC

(57) ABSTRACT

A pixel driving circuit, a display panel and a display device. The pixel driving circuit includes a driving and compensation sub-circuit; a data writing sub-circuit; and a coupling capacitance. A ratio of a capacitance value of the coupling capacitance to the sum of the capacitance value of the coupling capacitance and the capacitance value of the storage capacitance is configured to be greater than a preset value. The preset value is determined based on the preset maximum luminance fluctuation of the display panel. In the present application, the luminance fluctuation is adjusted by adjusting the correlation relationship between the capacitance value of the coupling capacitance and the capacitance (Continued)

value of the storage capacitance. Thus, a new capacitance configuration is provided, the panel can be adjusted at a capacitance level, and a better display effect is provided.

17 Claims, 3 Drawing Sheets

PIXEL DRIVING CIRCUIT HAVING A COUPLING CAPACITANCE AND DISPLAY PANEL THEREOF

CROSS-REFERENCE TO RELATED APPLICATION

Pursuant to 35 U.S.C. § 119 and the Paris Conversion, this application claims the benefit of Chinese Patent Application No. 202210756405.2 filed Jun. 30, 2022, the entire contents of which is incorporated herein by reference.

FIELD

The present application relates to the field of displaying technology, and more particularly to a pixel driving circuit, a display panel and a display device.

BACKGROUND

The statements provided herein are merely background information relate to the present application, and do not necessarily constitute any prior arts. With the development of the technical field of LCD (Liquid Crystal Display), OLED (Organic Light Emitting Display) display technology has been gradually widely used in products such as TV, mobile phones, laptops due to OLED's technological advantages such as self-luminescence, lightness and thinness. Since OLED is driven by current, when a threshold voltage Vth of a TFT (Thin Film Transistor) is shifted, the current that drives the OLED will be unstable and will be changed, and thus inhomogeneous luminance is caused. Currently, current compensation is performed through a driving compensation circuit, the driving compensation circuit includes a TFT and a capacitance connected to a pixel unit, a control terminal of the TFT is connected to a data voltage, an input terminal of the TFT is connected to a drive voltage, an output terminal and a control terminal of the TFT is connected to the capacitance, so that the voltage written into the pixel unit can be adjusted by the data voltage. The operation of the pixel driving circuit includes four stages, that is, reset, compensation, writing and luminescence. Due to the fluctuations in a manufacture procedure, the magnitude of the threshold voltage is variable, that is, the current flowing through the channel is variable. The influence on the threshold voltage of a conduction channel constituted by components can be eliminated through the internal compensation circuit. However, researches on the configuration of capacitance in the prior art are insufficient, researches on the influence of different capacitance configurations on the compensation effect are insufficient, thus, there are many deficiencies in the prior art.

SUMMARY

The present application provides a pixel driving circuit, a display panel and a display device, and aims at solving the problem in the exemplary technology that the conventional method for using a three-terminal device to compensate a driving switch has reached the peak, and there is an insurmountable bottleneck, it is urgent to provide a compensation method that can surmount the above bottleneck.

In the first aspect, one embodiment of the present application provides a pixel driving circuit applied to a display panel, the display panel includes a plurality of pixels, each of the pixels comprises a plurality of sub-pixels. The pixel driving circuit includes:

a driving and compensation sub-circuit which includes a driving transistor and a storage capacitance. An input terminal of the driving transistor is coupled to a driving voltage terminal, an output terminal of the driving transistor is coupled to one of the plurality of sub-pixels, one end of the storage capacitance is coupled to an input terminal of the driving transistor, the other end of the storage capacitance is coupled to the output terminal of the driving transistor.

The pixel driving circuit includes a data writing sub-circuit. An output terminal of the data writing sub-circuit is coupled to a control terminal of the driving transistor to write a data voltage into the control terminal of the driving transistor.

The pixel driving circuit includes a coupling capacitance. One end of the coupling capacitance is coupled to the output terminal of the driving transistor, the other end of the coupling capacitance is coupled to the control terminal of the driving transistor. A ratio of a capacitance value of the coupling capacitance to a sum of a capacitance value of the coupling capacitance and a capacitance value of the storage capacitance is greater than a preset value, and the preset value is determined based on a preset maximum luminance fluctuation of the display panel.

In one preferable embodiment, the data writing sub-circuit includes a data writing control transistor. A control terminal of the data writing control transistor is coupled to a first gate control signal line, an input terminal of the data writing control transistor is coupled to a data voltage terminal, and an output terminal of the data writing control transistor is coupled to the control terminal of the driving transistor.

In one preferable embodiment, the pixel driving circuit further includes an input control transistor. A control terminal of the input control transistor is coupled to an emission signal line, an input terminal of the input control transistor is coupled to the driving voltage terminal, and an output terminal of the input control transistor is coupled to the input terminal of the driving transistor.

In one preferable embodiment, the pixel driving circuit further includes a reset circuit configured to pull down a voltage at one end of the storage capacitance coupled to the sub-pixel to a reset voltage in response to a reset response voltage output from a reset response voltage line.

In one preferable embodiment, the pixel driving circuit further includes a reset transistor. A control terminal of the reset transistor is coupled to a second gate control signal line, input and output terminals of the reset transistor is coupled between the output terminal of the driving transistor and a reset voltage terminal.

In one preferable embodiment, the pixel driving circuit is arranged to be cascaded in the display panel. The first gate control signal line and the second gate control signal line are a gate signal line corresponding to the current pixel driving circuit and a gate signal line corresponding to an upper level of pixel driving circuit adjacent to the current pixel driving circuit, respectively.

In the second aspect, one embodiment of the present application provides a pixel driving method applied to a display panel, the display panel includes a plurality of sub-pixels, the pixel driving method particularly includes driving the plurality of sub-pixels by using the pixel driving circuit.

In the third aspect, one embodiment of the present application provides a display device. The display device includes a display panel and the aforesaid pixel driving circuit. The display panel includes a plurality of pixels, each pixel unit includes a plurality of luminescent devices.

It can be seen from the technical solutions described above that, the driving and compensation sub-circuit, the data writing sub-circuit and the coupling capacitance are provided in the pixel driving circuit, the display panel and the display device of the present application, and the ratio of the capacitance value of the coupling capacitance to the sum of the capacitance value of the coupling capacitance and the capacitance value of the storage capacitance is configured to be greater than the preset value. The preset value is determined based on the preset maximum luminance fluctuation of the display panel. In the present application, the luminance fluctuation is adjusted by adjusting the correlation relationship between the capacitance value of the coupling capacitance and the capacitance value of the storage capacitance. Thus, a new capacitance configuration is provided. The preset value can be adjusted according to the preset maximum luminance fluctuation, so that the panel can be regulated at the capacitance level, and a better display effect is provided.

BRIEF DESCRIPTION OF THE DRAWINGS

In order to describe the technical solutions in the embodiments of the present application or the prior art the more clearly, a brief introduction regarding the accompanying drawings that need to be used for describing the embodiments of the present application or the existing technology is given below; it is obvious that the accompanying drawings described below are merely some embodiments of the present application, a person of ordinary skill in the art may also acquire other drawings according to the current drawings without paying creative labor.

DETAILED DESCRIPTION OF THE EMBODIMENTS

In order to make the purpose, the technical solution and the advantages of the present application be clearer and more understandable, the present application will be further described in detail below with reference to accompanying figures and embodiments. It should be understood that the embodiments described in detail herein are merely intended to illustrate but not to limit the present application.

Furthermore, terms such as "the first" and "the second" are merely for the purpose of illustration, and thus should not be considered as indicating or implying any relative importance, or implicitly indicating the number of indicated technical features. Thus, technical feature(s) restricted by "the first" or "the second" may include one or more such technical feature(s) explicitly or implicitly. In the description of the present application, "a plurality of" has the meaning of at least two, unless there is additional explicit and specific limitation. It should be noted that the pixel driving circuit, the display panel and the display device disclosed in the present application can be used in the field of display technology or other fields other than the field of display technology. The application fields of the pixel driving circuit, the display panel and the display device disclosed in the present application are not limited.

Figure 1:
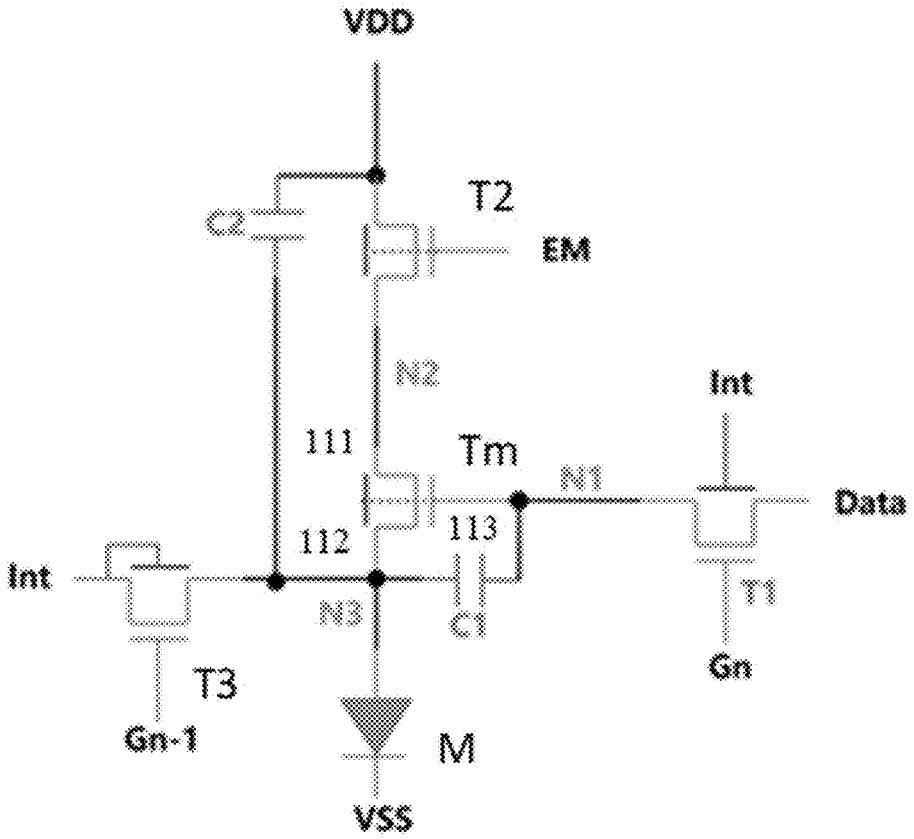
FIG. 1 is a schematic circuit diagram of a pixel driving circuit in one embodiment of the present application.

FIG. 1 is a circuit configuration diagram of a pixel driving circuit according to the present application. As shown in FIG. 1, it can be known that the pixel driving circuit of the present application is applied to a display panel. The display panel includes a plurality of pixels, each of the pixels includes a plurality of sub-pixels, and each of pixel driving circuits corresponds to the sub-pixels in a one-to-one correspondence manner.

As shown in FIG. 1, the pixel driving circuit includes a driving and compensation sub-circuit, the driving and compensation sub-circuit includes a driving transistor Tm and a storage capacitance C2. An input terminal 111 of the driving transistor Tm is coupled to a drive voltage terminal VDD, and an output terminal 112 of the driving transistor is coupled to a sub-pixel M. One end of the storage capacitance C2 is coupled to an input terminal 111 of the driving transistor Tm, and the other end of the storage capacitance C2 is coupled to an output terminal 112 of the driving transistor Tm. The pixel driving circuit further includes a data writing sub-circuit 12, an output terminal of the data writing sub-circuit 12 is coupled to a control terminal 113 of the driving transistor Tm so as to write data voltage into the control terminal 113 of the driving transistor Tm and the coupling capacitance C1 in the data writing process. One end of the coupling capacitance C1 is coupled to the output terminal of the driving transistor Tm, and the other end of the coupling capacitance C1 is coupled to the control terminal of the driving transistor Tm. A ratio of the capacitance value of the coupling capacitance C1 to the sum of the capacitance value of the coupling capacitance C1 and the capacitance value of the storage capacitance C2 is greater than a preset value. The preset value is determined based on a preset maximum luminance fluctuation of the display panel.

The driving and compensation sub-circuit, the data writing sub-circuit and the coupling capacitance are provided in the pixel driving circuit, and a ratio of the capacitance value of the coupling capacitance to a sum of the capacitance value of the coupling capacitance and the capacitance value of the storage capacitance is configured to be greater than a preset value. The preset value is determined based on a preset maximum luminance fluctuation of the display panel. In the present application, the luminance fluctuation is adjusted by adjusting the correlation relationship between the capacitance value of the coupling capacitance and the capacitance value of the storage capacitance. Thus, a new capacitance configuration method is provided. The preset value can be adjusted according to the preset maximum luminance fluctuation, so that the panel can be regulated at the capacitance level, and a better display effect is provided.

Figure 4:
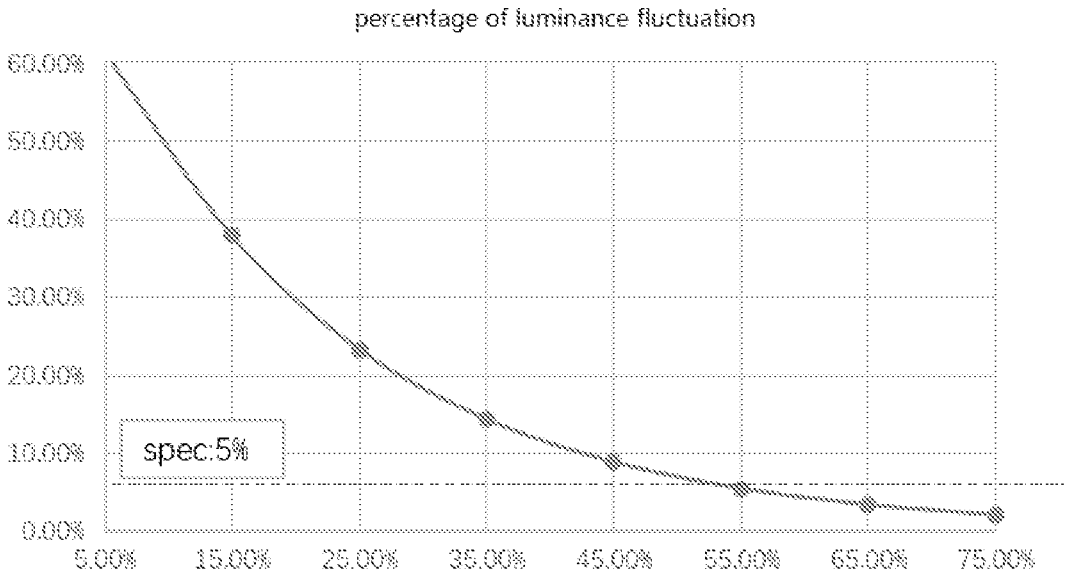
FIG. 4 is a function graph reflecting a relationship between luminance fluctuation and a preset value in one embodiment of the present application.

In this embodiment of the present application, the aforesaid preset value can be determined based on the preset maximum luminance fluctuation of the display panel. In particular, the corresponding relationship between the percentage of luminance fluctuation and the aforesaid preset value is found based on lots of researches, and a fitting curve is formed, which is shown in FIG. 4. It can be seen from FIG. 4 that the percentage of luminance fluctuation is negatively correlated to the aforesaid preset value.

Furthermore, in the production process of the back plate, the thickness and the quality of the film of the PVD/CVD film are always uneven in distribution in different regions, and conductive processing processes and the sizes of exposure patterns are also different in distribution. This uneven distribution will be more obvious especially in the back plate in large generation production line. At present, a compensation capacitance C2 is only introduced to perform Vth compensation on the driving of TFT to improve homogeneity of in-plane current and improve the panel display effect.

However, it is found that the homogeneity of the large film layer would also affect the distribution of the capacitance of the compensation capacitance C2, and the range of the value of the capacitance will have an impact on the function of the voltage stabilization capacitance C2, and the display effect is affected finally. It is unknown in the prior art that the uniformity of the large film layer will also affect the distribution of the capacitance of the voltage stabilization capacitance C2, and how to solve this problem is even more unknown.

In this embodiment of the present application, after completing compensation and data writing, a gate voltage of the driving transistor T2 is $(Data-Vref)*(1-\alpha)+VSS+Voled+Vth, \alpha=C1/(C1+C2)$. It can be understood from the formula that the gate voltage will be affected by the capacitance values of a capacitance C1 and a capacitance C2 and a proportional relationship of the capacitance C1 and the capacitance C2, the gate electrode is a controlled gray scale for controlling the driving transistor.

In this embodiment of the present application, the requirement of the specification of the maximum luminance fluctuation is less than 10%. When the requirement of specification is 5%, the optimal display effect is realized. Thus, in the pixel driving circuit, the fluctuation corresponding to $(1-\alpha)$ is less than 5%.

In this embodiment of the present application, a curve that reflects a corresponding relationship between the preset value and the preset maximum luminance fluctuation of the display panel is generated, as shown in FIG. 4. In particular, in the present application, a curve of the percentage of luminance fluctuation of each panel can be obtained through experiments. According to the design of the ratio of the capacitance value of the capacitance C1 to the capacitance value of the capacitance C2, experimental data with luminance fluctuation adjustment of 1%, 2% and up to 60% can be obtained. Then, a luminance fluctuation percentage fitted curve is formed by fitting the experimental data. As shown in FIG. 4, a luminance fluctuation percentage curve is obtained by fitting the data obtained by conducting a luminance fluctuation experiment on a panel product. After fitting the experimental data, a numerical relationship of $C2/(C2+C1)$ is derived under the fluctuation percentage of 0-60% in the present application. It can be seen from FIG. 4 that, when the luminance fluctuation percentage is 5%, the optimal correlation between C2 and C1 is $C2/(C2+C1) > 55\%$.

Furthermore, it can be known that the preset maximum luminance fluctuation of the display panel is in the range of 5% and 10%. Correspondingly, the preset value is greater than or equal to 55%.

Furthermore, in this embodiment of the present application, the pixel driving circuit is applied to the display panel. The display panel includes a plurality of sub-pixels, and the sub-pixels can be red, blue or green sub-pixels. Generally, three sub-pixels constitute one pixel unit, and this pixel unit is the smallest integrated unit that constitutes a pixel arrangement structure. This pixel arrangement structure constitutes a display area of the display panel, that is, the pixel arrangement includes a plurality of pixels arranged in a specific arrangement. Each pixel includes a plurality of sub-pixels, such as a red sub-pixel, a blue sub-pixel, and a green sub-pixel. Each sub-pixel is electrically connected to driving IC (Integrated Circuit) through one single driving line, and the driving IC is used to drive the sub-pixels in the pixels to be powered up to emit color light.

It can be known that, in the present application, the sub-pixels in one pixel unit can include red sub-pixels, blue sub-pixels and green sub-pixels, and the number of sub-pixels can be three or four, etc. The number of sub-pixels included in one single pixel unit is not limited in the present application.

When there are three sub-pixels in one pixel unit, the sub-pixels are generally red, blue and green sub-pixels. When there are four sub-pixels, the colors of the sub-pixels can be red, blue, green and other color that is different from red, blue and green. For example, said other color can include white, yellow or cyan. It should be noted that if said other color is white, the display luminance of the display device with this pixel arrangement structure can be improved. If said other color is another color, the color gamut of the display device can be increased, said other color is not limited in the present application.

Furthermore, it should be understood that the transistor of the present application is a TFT (Thin Film Transistor). Some components of the pixel driving circuit can be arranged in a non-display area of the display panel. Therefore, in some embodiments, the transistor can also be other types of transistors, and the type of the transistor is not limited in the present application.

The transistor in the present application generally includes a control terminal, an input terminal and an output terminal. Correspondingly, the control terminal is the gate electrode of the transistor, and the input terminal and the output terminal are the source electrode and the drain electrode of the transistor.

In one preferable embodiment, the data writing sub-circuit in the present application includes a data writing control transistor T1. A control terminal of the data writing control transistor T1 is coupled to the first gate control signal line, an input terminal of the data writing control transistor T1 is coupled to the data voltage terminal, and an output terminal of the data writing control transistor T1 is coupled to the control terminal of the driving transistor.

The data writing control transistor T1 is used to control the time when the data voltage line writes data voltage into the control terminal of the driving transistor Tm, and thereby control the data voltage written into the control terminal of the driving transistor Tm by controlling the driving transistor T1 to be switched on through data write control in the reset, compensation, writing and luminescence stages.

Furthermore, in one preferable embodiment, the pixel driving circuit further includes an input control transistor T2, a control terminal of the input control transistor T2 is coupled to an emission signal line EM, an input terminal of the input control transistor T2 is coupled to the driving voltage terminal VDD, and an output terminal of the input control transistor T2 is coupled to an input terminal 111 of the driving transistor Tm. In this embodiment, the timing when the drive voltage is written into the driving transistor Tm is controlled by the input control transistor T2, so that the driving transistor Tm can be controlled differently at different stages.

It should be understood that, a signal output from the emission signal line EM is generated by using an emission power source voltage, a clock signal and a scanning signal, which are not repeatedly described in the present application.

Furthermore, as shown in FIG. 1, in some embodiments, both ends of the storage capacitance C2 in the present application are respectively coupled to the output terminal of the drive voltage terminal VDD and the output terminal of the driving transistor Tm. In this embodiment, the storage capacitance C2 is used to stabilize the voltage at the node N3 in FIG. 1, thereby alleviating the problem of current leakage that occurs at the output terminal of the driving transistor Tm.

Furthermore, in some embodiments, the pixel driving circuit further includes a reset circuit that pulls down a voltage at one end of the storage capacitance coupled to the sub-pixel to a reset voltage, in response to a reset response voltage output through a reset response voltage line.

Figure 3:
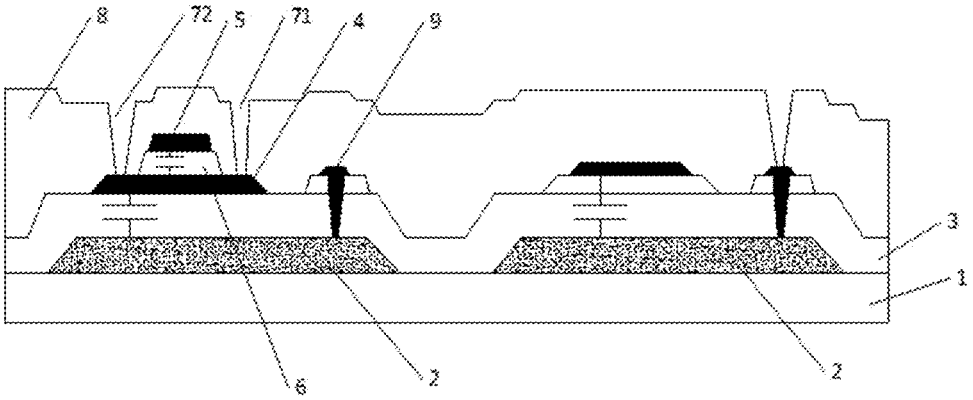
FIG. 3 is a schematic diagram of a layer structure of a driving switch in FIG. 1.

In some embodiments, as shown in FIG. 3, the reset circuit includes a reset transistor T3. A control terminal of the reset transistor T3 is coupled to the second gate control signal line Gn-1, input and output terminals of the reset transistor T3 are coupled between the output terminal of the driving transistor Tm and a reset voltage terminal (i.e., the output terminal of the reset signal line Int). The reset transistor T3 is used to reset the voltage between the driving transistor Tm and the sub-pixel to the reset voltage in the reset stage, when the driving transistor Tm is switched-off.

Figure 2:
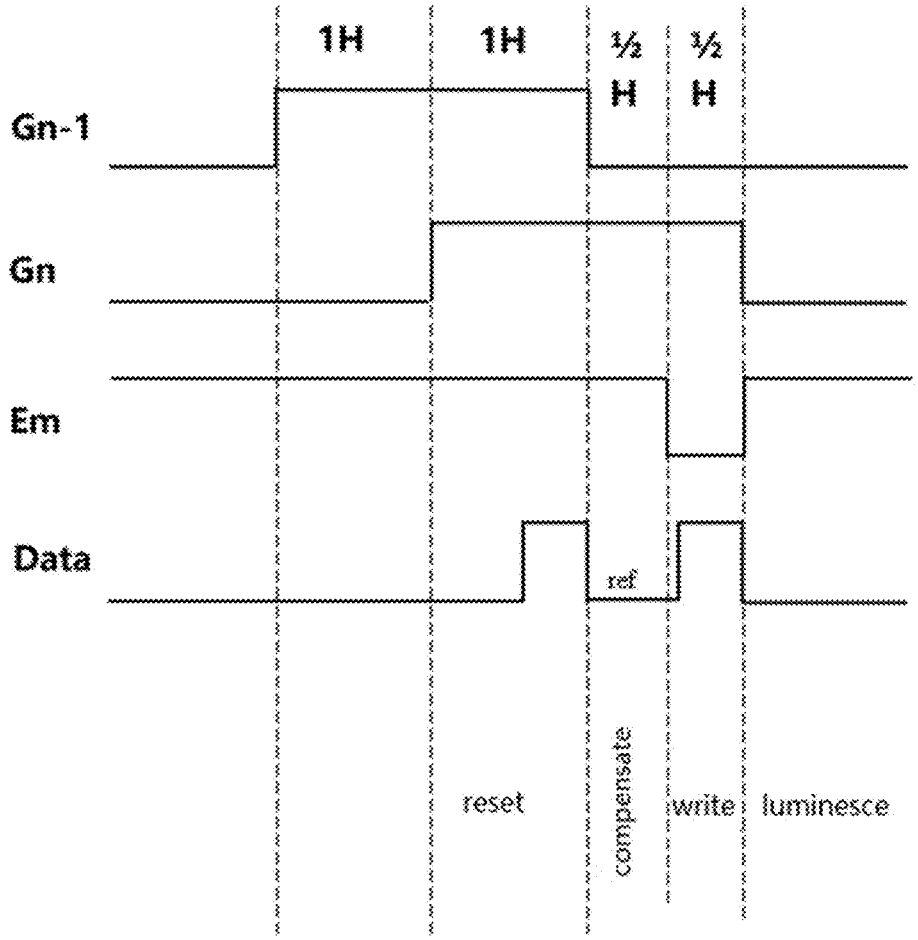
FIG. 2 is a schematic diagram of a timing control corresponding to FIG. 1.

The present application will be described in detail below with reference to the timing diagram shown in FIG. 2.

First, in the reset stage, the first gate control signal line Gn is pulled up to be at high level, written data is at low level in the first half of the reset interval, and written data is at high level in the second half of the reset interval, so that the driving transistor Tm is switched-off in the first half of the reset interval and is switched-on in the second half of the reset interval, the luminescent current of the OLED device is conductive; the second gate control signal line Gn-1 is pulled up to be at high level, the reset transistor is switched-on, a node of the storage capacitance adjacent to the node N3 is charged to a reference voltage, and node N1 is charged through the coupling capacitance C1 until the node N1 is reset to the reference voltage.

Second, in the compensation stage, the first gate control signal line is continued to be at high level, the second gate control signal line is at a low level, and the data line is at a low level, so that the driving transistor are kept at a switched-off state; a driving voltage is written into the node N2; the reference voltage is written into the node N1 and one end of the capacitance C1 adjacent to the node N1.

Then, in the writing stage, if the first gate control signal line is at high level and the data voltage line is at high level, the data voltage writing transistor T1 is switched-on, and the coupling capacitance C1 is charged. When the coupling capacitance C1 is fully charged, the emission signal line is pulled down to be at low level, the driving transistor Tm is not conductive, and data voltage is written into the node N1.

Finally, in the luminescence stage, both the first gate control signal line and the second gate control signal line are switched to low potential, the data writing control transistor T1 and the reset transistor T3 are switched-off, the potential of the node N1 is maintained, so that the driving transistor is kept at switched-on state, the emission signal line is pulled up to be at high level, the driving voltage VDD is written into the driving transistor, so that the current flows into the anode of the OLED luminescent device, provides holes for the OLED luminescent device, and the holes are recombined with the electrons transmitted in the cathode to emit light.

Furthermore, in this embodiment of the present application, due to the increase of the leakage current of the panel under high temperature, the current in the panel may flow back to the driving voltage terminal VDD, thereby affecting the stability of the current supplied from the driving voltage terminal VDD. The diode of the present application can prevent large current in the panel from flowing back to the driving voltage terminal VDD.

A person or ordinary skill in the art should understand that the "coupling" in the present application may refer to a direct or indirect electrical connection. For example, if A and B are coupled, there may be a direct electrical connection between A and B. As an alternative, A and B may be electrically connected through C. the meaning of "coupling" is not limited in the present application.

It should be understood that the driving and compensation sub-circuit, the data writing sub-circuit and the coupling capacitance are provided in the pixel driving circuit of the present application, and the ratio of the capacitance value of the coupling capacitance to the sum of the capacitance value of the coupling capacitance and the capacitance value of the storage capacitance is configured to be greater than the preset value. The preset value is determined based on the preset maximum luminance fluctuation of the display panel. In the present application, the luminance fluctuation is adjusted by adjusting the correlation relationship between the capacitance value of the coupling capacitance and the capacitance value of the storage capacitance. Thus, a new capacitance configuration is provided. The preset value can be adjusted according to the preset maximum luminance fluctuation, so that the panel can be regulated at the capacitance level, and a better display effect is provided.

A display panel is provided in the present application, the display panel includes a plurality of pixels and a plurality of pixel driving circuits as described in the first embodiment, each of the pixels includes a plurality of sub-pixels, and all sub-pixels in the display panel correspond to the pixel driving circuits in a one-to-one correspondence manner.

It should be understood that, since the driving and compensation sub-circuit, the data writing sub-circuit and the coupling capacitance are provided in the pixel driving circuit of the display panel in the present application, and the ratio of the capacitance value of the coupling capacitance to the sum of the capacitance value of the coupling capacitance and the capacitance value of the storage capacitance is configured to be greater than the preset value. The preset value is determined based on the preset maximum luminance fluctuation of the display panel. In the present application, the luminance fluctuation is adjusted by adjusting the correlation relationship between the capacitance value of the coupling capacitance and the capacitance value of the storage capacitance. Thus, a new capacitance configuration is provided. The preset value can be adjusted according to the preset maximum luminance fluctuation, so that the panel can be regulated at the capacitance level, and a better display effect is provided.

Figure 5:
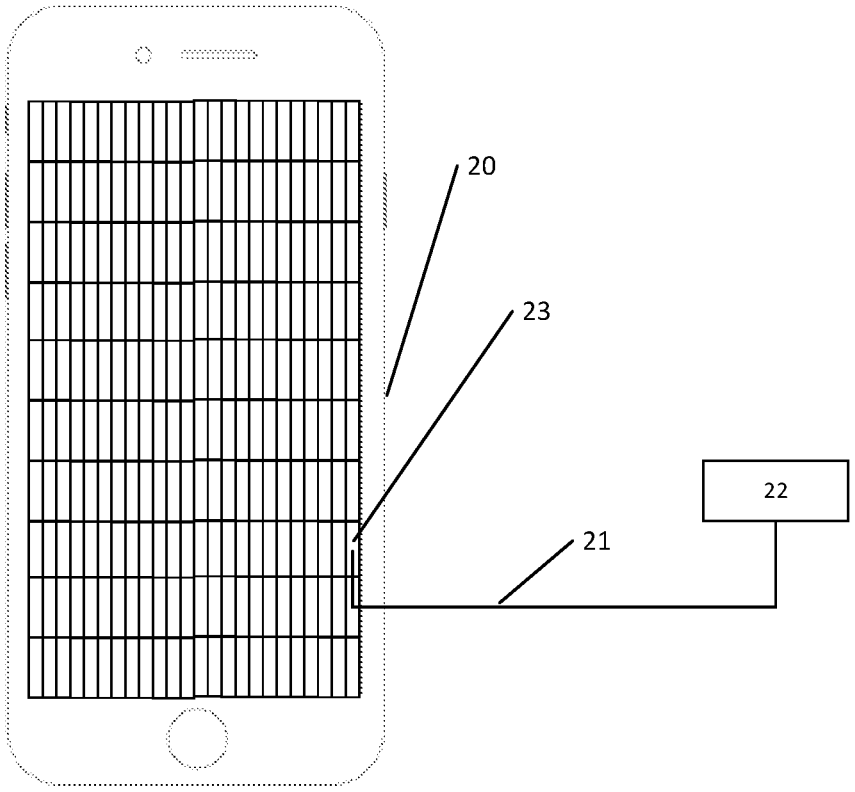
FIG. 5 is a schematic structural diagram of a display device according to one embodiment of the present application.

As shown in FIG. 5, a display device 20 in the present application includes a display panel and the pixel driving circuit 22 as described in the first embodiment. The display panel includes a plurality of pixels, and the pixel driving circuit is coupled to the sub-pixels in each of the pixels through a conducting wire 21.

In implementation, the display device 20 according to this embodiment of the present application can be any product or device having display function, such as mobile phone, tablet computer, TV, display, notebook computer, digital photo frame, navigator, etc.

It should be understood that, since the driving and compensation sub-circuit, the data writing sub-circuit and the coupling capacitance are provided in the pixel driving circuit of the display device 20 of the present application, and the ratio of the capacitance value of the coupling capacitance to the sum of the capacitance value of the coupling capacitance and the capacitance value of the storage capacitance is configured to be greater than the preset value. The preset value is determined based on the preset maximum luminance fluctuation of the display panel. In the present application, the luminance fluctuation is adjusted by adjusting the correlation relationship between the capacitance value of the coupling capacitance and the capacitance value of the storage capacitance. Thus, a new capacitance configuration is provided. The preset value can be adjusted according to the preset maximum luminance fluctuation, so that the panel can be regulated at the capacitance level, and a better display effect is provided.

A pixel driving method for the display device is provided in the present application, this method is applied to a display panel. The display panel includes a plurality of pixels. The pixel driving method particularly includes the steps for driving the pixels using the pixel driving circuit described above.

The steps in the present application will be described in detail below with reference to the embodiments corresponding to FIG. 1 and FIG. 2.

FIG. 1 is a timing diagram corresponding to the embodiment of FIG. 1. As shown in FIG. 2, the whole process is divided into four stages.

First, in the reset stage, the first gate control signal line Gn is pulled up to be at high level, written data is at low level in the first half of the reset interval, and written data is at high level in the second half of the reset interval, so that the driving transistor Tm is switched-off in the first half of the reset interval and is switched-on in the second half of the reset interval, the luminescent current of the OLED device is conductive; the second gate control signal line Gn-1 is pulled up to be at high level, the reset transistor is switched-on, a node of the storage capacitance adjacent to the node N3 is charged to a reference voltage, and node N1 is charged through the coupling capacitance C1 until the node N1 is reset to the reference voltage.

Second, in the compensation stage, the first gate control signal line is continued to be at high level, the second gate control signal line is at a low level, and the data line is at a low level, so that the driving transistor are kept at a switched-off state; a driving voltage is written into the node N2; the reference voltage is written into the node N1 and one end of the capacitance C1 adjacent to the node N1.

Then, in the writing stage, if the first gate control signal line is at high level and the data voltage line is at high level, the data voltage writing transistor T1 is switched-on, and the coupling capacitance C1 is charged. When the coupling capacitance C1 is fully charged, the emission signal line is pulled down to be at low level, the driving transistor Tm is not conductive, and data voltage is written into the node N1.

Finally, in the luminescence stage, both the first gate control signal line and the second gate control signal line are switched to low potential, the data writing control transistor T1 and the reset transistor T3 are switched-off, the potential of the node N1 is maintained, so that the driving transistor is kept at switched-on state, the emission signal line is pulled up to be at high level, the driving voltage VDD is written into the driving transistor, so that the current flows into the anode of the OLED luminescent device, provides holes for the OLED luminescent device, and the holes are recombined with the electrons transmitted in the cathode to emit light.

It can be seen from the technical solutions described above that, in the driving method provided in this embodiment of the present application, the driving and compensation sub-circuit, the data writing sub-circuit and the coupling capacitance are provided, and the ratio of the capacitance value of the coupling capacitance to the sum of the capacitance value of the coupling capacitance and the capacitance value of the storage capacitance is configured to be greater than the preset value. The preset value is determined based on the preset maximum luminance fluctuation of the display panel. In the present application, the luminance fluctuation is adjusted by adjusting the correlation relationship between the capacitance value of the coupling capacitance and the capacitance value of the storage capacitance. Thus, a new capacitance configuration is provided. The preset value can be adjusted according to the preset maximum luminance fluctuation, so that the panel can be regulated at the capacitance level, and a better display effect is provided.

It should be noted that, regarding the embodiment of the driving circuit, the embodiment of the display device, the embodiment of the pixel driving method provided by the embodiments of the present application, reference can be made to each other, these embodiments are not limited in the present application. The steps of the embodiment of the method for manufacturing the display panel according to the embodiment of the present application can be added or deleted according to the requirement. Improved methods, which can be easily thought of by any person who is skilled in the art and is familiar with the technical field within the technical scope disclosed in the present application, should all be included in the protection scope of the present application. Thus, these improved methods are not repeatedly described here.

The foregoing embodiments are only preferable embodiments of the present application, and should not be regarded as limitations to the present application. All modifications, equivalent replacements and improvements, which are made within the spirit and the principle of the present application, should all be included in the protection scope of the present application.

What is claimed is:

1. A pixel driving circuit applied to a display panel which comprises a plurality of pixels, each of the pixels comprises a plurality of sub-pixels, the pixel driving circuit comprising:

a driving and compensation sub-circuit comprising a driving transistor and a storage capacitance, wherein an input terminal of the driving transistor is coupled to a driving voltage terminal, an output terminal of the driving transistor is coupled to one of the plurality of sub-pixels, one end of the storage capacitance is coupled to an input terminal of the driving transistor, the other end of the storage capacitance is coupled to the output terminal of the driving transistor;

a data writing sub-circuit, wherein an output terminal of the data writing sub-circuit is coupled to a control terminal of the driving transistor to write a data voltage into the control terminal of the driving transistor; and a coupling capacitance, wherein one end of the coupling capacitance is coupled to the output terminal of the driving transistor, the other end of the coupling capacitance is coupled to the control terminal of the driving transistor; wherein a ratio of a capacitance value of the coupling capacitance to a sum of a capacitance value of the coupling capacitance and a capacitance value of the storage capacitance is greater than a preset value, and the preset value is determined based on a preset maximum luminance fluctuation of the display panel.

2. The pixel driving circuit of claim 1, wherein the data writing sub-circuit comprises:

a data writing control transistor, wherein a control terminal of the data writing control transistor is coupled to a first gate control signal line, an input terminal of the data writing control transistor is coupled to a data voltage terminal, and an output terminal of the data writing control transistor is coupled to the control terminal of the driving transistor.

3. The pixel driving circuit of claim 2, further comprising a reset circuit configured to pull down a voltage at one end of the storage capacitance coupled to the sub-pixel to a reset voltage in response to a reset response voltage output from a reset response voltage line.

4. The pixel driving circuit of claim 3, wherein the reset response voltage line is a second gate control signal line, the reset circuit comprises a reset transistor, a control terminal of the reset transistor is coupled to the second gate control signal line, an input terminal and an output terminal of the reset transistor are coupled between the output terminal of the driving transistor and a reset voltage terminal.

5. The pixel driving circuit of claim 4, wherein the pixel driving circuit is arranged to be cascaded in the display panel, the first gate control signal line and the second gate control signal line are a gate signal line corresponding to the current pixel driving circuit and a gate signal line corresponding to an upper level of pixel driving circuit adjacent to the current pixel driving circuit, respectively.

6. The pixel driving circuit of claim 1, further comprising an input control transistor, wherein a control terminal of the input control transistor is coupled to an emission signal line, an input terminal of the input control transistor is coupled to the driving voltage terminal, and an output terminal of the input control transistor is coupled to the input terminal of the driving transistor.

7. The pixel driving circuit of claim 1, wherein a curve that reflects a corresponding relationship between the preset value and a preset maximum luminance fluctuation of the display panel is generated.

8. The pixel driving circuit of claim 7, wherein the preset maximum luminance fluctuation of the display panel is in a range of 5% and 10%, correspondingly, the preset value is equal to or greater than 55%.

9. A display panel, comprising a plurality of pixels and a plurality of the pixel driving circuits, wherein each pixel driving circuit comprises:

a driving and compensation sub-circuit comprising a driving transistor and a storage capacitance, wherein an input terminal of the driving transistor is coupled to a driving voltage terminal, an output terminal of the driving transistor is coupled to one of the plurality of sub-pixels, one end of the storage capacitance is coupled to an input terminal of the driving transistor, the other end of the storage capacitance is coupled to the output terminal of the driving transistor;

a data writing sub-circuit, wherein an output terminal of the data writing sub-circuit is coupled to a control terminal of the driving transistor to write a data voltage into the control terminal of the driving transistor; and a coupling capacitance, wherein one end of the coupling capacitance is coupled to the output terminal of the driving transistor, the other end of the coupling capacitance is coupled to the control terminal of the driving transistor; wherein a ratio of a capacitance value of the coupling capacitance to a sum of a capacitance value of the coupling capacitance and a capacitance value of the storage capacitance is greater than a preset value, and the preset value is determined based on a preset maximum luminance fluctuation of the display panel;

wherein each of the plurality of pixels comprises a plurality of sub-pixels, and the plurality of sub-pixels correspond to the plurality of pixel driving circuits in a one-to-one correspondence manner.

10. A display device, comprising the pixel driving circuit according to claim 9.

11. The display panel of claim 9, wherein the data writing sub-circuit comprises:

a data writing control transistor, wherein a control terminal of the data writing control transistor is coupled to a first gate control signal line, an input terminal of the data writing control transistor is coupled to a data voltage terminal, and an output terminal of the data writing control transistor is coupled to the control terminal of the driving transistor.

12. The display panel of claim 11, wherein the pixel driving circuit further comprises a reset circuit configured to pull down a voltage at one end of the storage capacitance coupled to the sub-pixel to a reset voltage in response to a reset response voltage output from a reset response voltage line.

13. The display panel of claim 12, wherein the reset response voltage line is a second gate control signal line, the reset circuit comprises a reset transistor, a control terminal of the reset transistor is coupled to the second gate control signal line, an input terminal and an output terminal of the reset transistor are coupled between the output terminal of the driving transistor and a reset voltage terminal.

14. The display panel of claim 13, wherein the pixel driving circuit is arranged to be cascaded in the display panel, the first gate control signal line and the second gate control signal line are a gate signal line corresponding to the current pixel driving circuit and a gate signal line corresponding to an upper level of pixel driving circuit adjacent to the current pixel driving circuit, respectively.

15. The display panel of claim 9, wherein the pixel driving circuit further comprises an input control transistor, wherein a control terminal of the input control transistor is coupled to an emission signal line, an input terminal of the input control transistor is coupled to the driving voltage terminal, and an output terminal of the input control transistor is coupled to the input terminal of the driving transistor.

16. The display panel of claim 9, wherein a curve that reflects a corresponding relationship between the preset value and a preset maximum luminance fluctuation of the display panel is generated.

17. The display panel of claim 16, wherein the preset maximum luminance fluctuation of the display panel is in a range of 5% and 10%, correspondingly, the preset value is equal to or greater than 55%.

* * * * *